US006302053B1

(12) United States Patent
Tomczak et al.

(10) Patent No.: US 6,302,053 B1
(45) Date of Patent: Oct. 16, 2001

(54) BOAT MOUNTABLE STOWABLE ENCLOSURE

(75) Inventors: Joseph B. Tomczak, Linden; Anthony J. Seconsky, Owosso, both of MI (US); Keith Arnold Kobe, Greenwood, SC (US)

(73) Assignee: Maurell Products, Inc., Owosso, MI (US)

( * ) Notice: Subject to any disclaimer, the term of this patent is extended or adjusted under 35 U.S.C. 154(b) by 0 days.

(21) Appl. No.: 09/496,362

(22) Filed: Feb. 2, 2000

(51) Int. Cl.[7] ..... B63B 17/00

(52) U.S. Cl. ..... 114/363; 160/333; 297/184.14; 4/460

(58) Field of Search ..... 114/343, 363; 297/184.14, 184.15, 188.08, 188.09, 188.1; 4/597, 599, 612, 460; 160/DIG. 6, 330, 333, 336

(56) References Cited

U.S. PATENT DOCUMENTS 4,883,016 * 11/1989 Larson ..... 114/363
5,029,348 * 7/1991 Boren ..... 4/449
5,862,540 * 1/1999 Chuan ..... 4/449

* cited by examiner

*Primary Examiner*—Sherman Basinger
(74) *Attorney, Agent, or Firm*—Rockey, Milnamow & Katz, Ltd.

(57) ABSTRACT

An assembly mountable to the transom of a watercraft, such as a pontoon boat, provides an easy-to-set up, temporarily deployable, changing room or privacy region on watercraft which do not carry an enclosed cabin. A generally Z-shaped frame is rotatably attached to a portion of the boat displaced from the deck. A boater's seat is attached on one side of the frame. A generally U-shaped curtain hoop is rotatably attached to a second side of the frame. When the bracket and seat are rotated toward the deck, the hoop is positioned in a stored position. When the bracket and seat are rotated away from the deck, the hoop can be deployed from its stored position thereby extending an enclosure fabric forming, temporarily, an enclosed privacy region for changing and the like. The fabric support member can be springloaded as can the bracket. Stowing the assembly is easily carried out by pressing the fabric support element against the bottom of the seat. This draws the fabric back against the seat. A retaining strap can be used to enclose the fabric. The seat can then be rotated down to its normal position of use.

48 Claims, 4 Drawing Sheets

FIG. 5
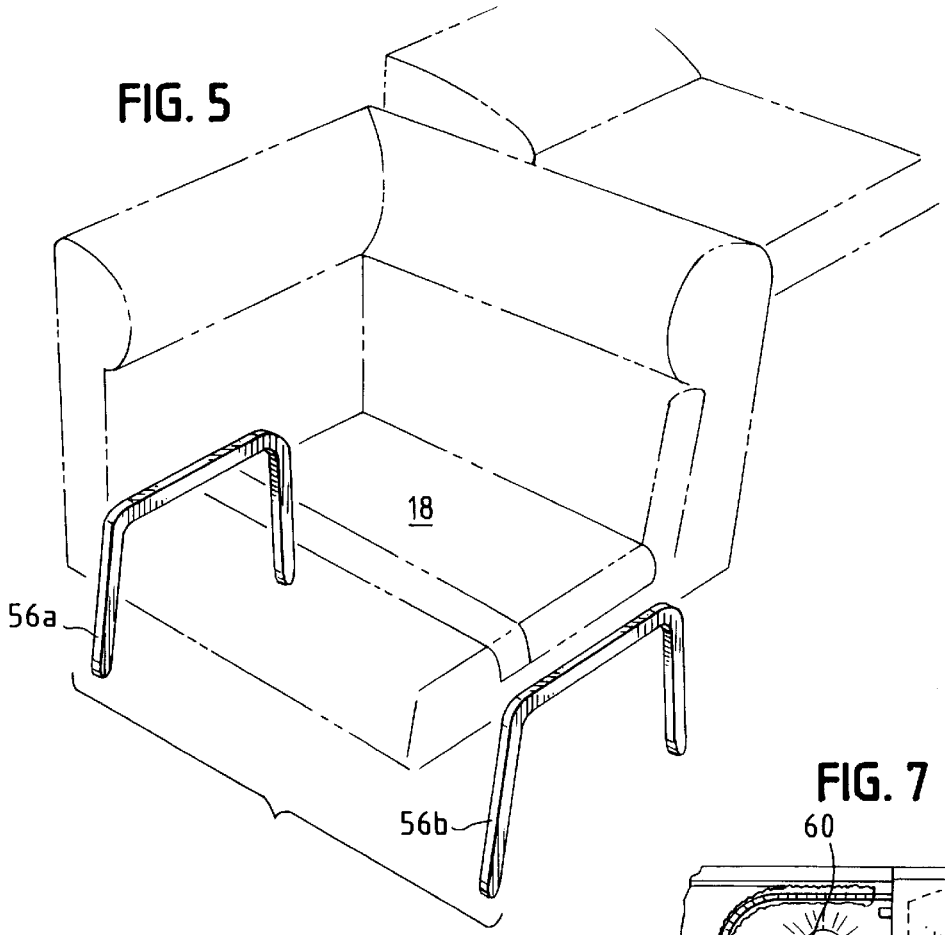
FIG. 7
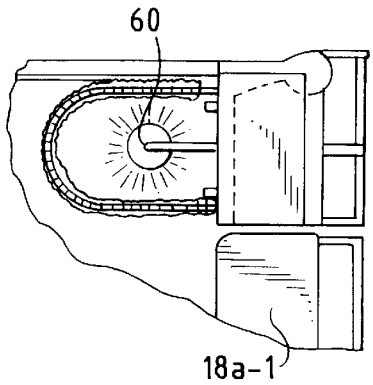
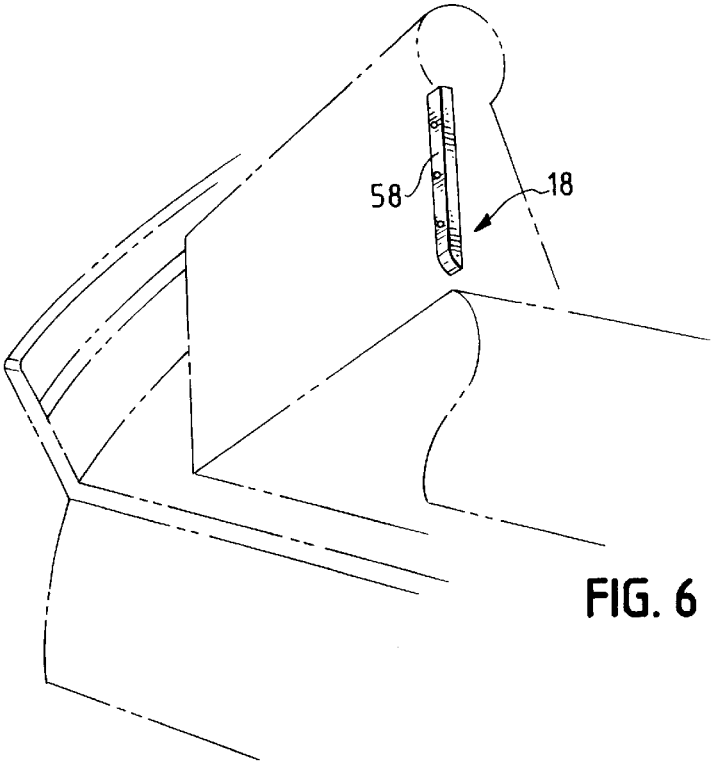
FIG. 6

BOAT MOUNTABLE STOWABLE ENCLOSURE

FIELD OF THE INVENTION

The invention pertains to equipment usable on movable platforms, such as watercraft, to enhance usage and convenience of such vehicles. More particularly, the invention pertains to a vehicle mountable, changing or privacy enclosure which can easily be deployed or stowed away without taking up valuable vehicle space when not in use.

BACKGROUND OF THE INVENTION

Movable platforms, such as watercraft, are very popular and extensively used for both commercial and recreational purposes. Watercraft usually have a size and a shape which promote efficiency of usage of the available square footage of deck. Despite manufacturing advances which incorporate resins and glass fibers along with associated construction techniques, it is at times difficult to cost justify increasing the size of the given craft merely to provide a heightened level of convenience or ease of use.

Watercraft are often used for extended recreational and vacation trips on both inland lakes, and waterways as well as along various coasts, as typified by the intercostal waterway. Certain types of watercraft, such as pontoon boats, are cost effectively constructed without enclosed cabins. There are times when on day trips or longer overnight trips that it would be useful and convenient for an individual riding such watercraft to have a cabin or other area of privacy available for changing or for other purposes. It is not at all unusual in recreational boating for the users to wrap themselves in towels for changing purposes while on the water or to temporarily tie up at a marina to use publicly available facilities.

To improve boating enjoyment and convenience, it would be useful and desirable to be able to temporarily provide a changing enclosure or region of privacy on watercraft which do not have cabins. It would also be preferable to provide such functionality without permanently occupying portions of the available deck space when the facility is not being used.

SUMMARY OF THE INVENTION

An apparatus for deploying and then storing away a changing enclosure or region of privacy, mountable on a movable platform such as a watercraft, includes a pivotable assembly, such as a hinge, for attaching the apparatus to a transom or other portion of the watercraft. An integral seat and transom cover are carried on a pivotable bracket which is attached to the hinge.

The seat can be rotated downwardly, toward the deck of the craft, to a stable position corresponding to normal sitting position. When so-located, individuals on the watercraft can sit or use the seat for its normal purpose. In this configuration, the enclosure is stored out of the way and out of sight.

The seat, the portion of the transom cover, and attached bracket can be rotated upwardly, away from the deck, to a second, stable position. In this position, the seat has been tipped back relative to the deck and can no longer be used for its normal purpose.

A curtain hoop, rotatably attached to the bottom of the seat, can be rotated from its stored position, adjacent to and extending along the bottom of the seat, to an extended position substantially perpendicular thereto. In this position, an opaque, planar, flexible fabric member, perhaps formed of a selected plastic, will extend substantially vertical to the deck of the craft supported to form an enclosed region formed by the hoop.

The fabric can be opened, such as by unzipping same, and moved aside to enable a boater to enter the enclosed region. The fabric can then be reclosed, such as by zipping it shut, thereby forming an enclosed private region adjacent to the bottom of the seat wherein a boater can change clothes or carry out any other desired function.

When finished, the boater can exit the enclosed region, and restow the enclosing fabric adjacent to the bottom of the seat. The assembly can then be rotated downwardly toward the deck restowing the fabric under the seat and out of the way. The seat can then be used for normal purposes.

In one embodiment, shock absorbers, such as gas struts, coupled between the bracket and adjacent transom areas can be used to keep the assembly in an upright position when in use. Similarly, the curtain hoop or loop can be springloaded with a biasing member, such as a gas strut, to maintain the fabric in an extended position while in use.

It will be understood that a variety of fabrics or fabric configurations can be supported on the hoop, a substantially U-shaped member, without departing form the spirit and scope of the present invention.

Numerous other advantages and features of the present invention will become readily apparent from the following detailed description of the invention and the embodiments thereof, from the claims and from the accompanying drawings.

BRIEF DESCRIPTION OF THE DRAWINGS

FIG. 5 illustrates additional aspects of the apparatus of FIG. 4;

FIG. 6 illustrates other aspects of the apparatus of FIG. 4; and

FIG. 7 illustrates an alternate embodiment of the apparatus of FIG. 1.

DETAILED DESCRIPTION OF THE PREFERRED EMBODIMENTS

Figure 1:
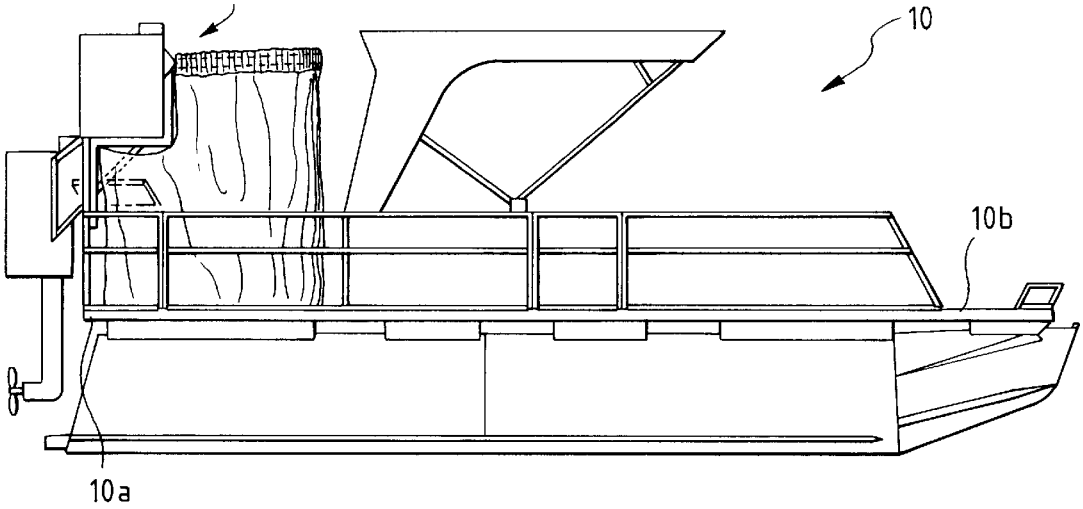
FIG. 1 is a side elevational view of a pontoon boat with a deployed enclosure in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates a water vehicle, such as a pontoon boat, 10 which carries a deployable changing or privacy room generally indicated at 12. The apparatus 12 is illustrated mounted at the stern 10*a* of boat 10. It will be understood that other mounting locations as well as other types of platforms come within in the spirit and scope of the present invention.

Apparatus 12 is hingedly attached to the stern 10*a* above the deck 10*b*. When deployed, as illustrated in FIG. 1 an enclosed region is established on deck 10*b* for a limited period of time. As described below, the apparatus 12 can be stowed, when not in use so as not to occupy deck space and so as not to block the view of those on the boat.

The apparatus 12 is especially useful to boaters because it can be deployed to set up a privacy area or a changing region on the deck 10*b* which otherwise does not carry an enclosed cabin. Typical uses of apparatus 12 include changing of clothes, showering (see FIG. 7), usage of portable toilets and the like.

Figure 2:
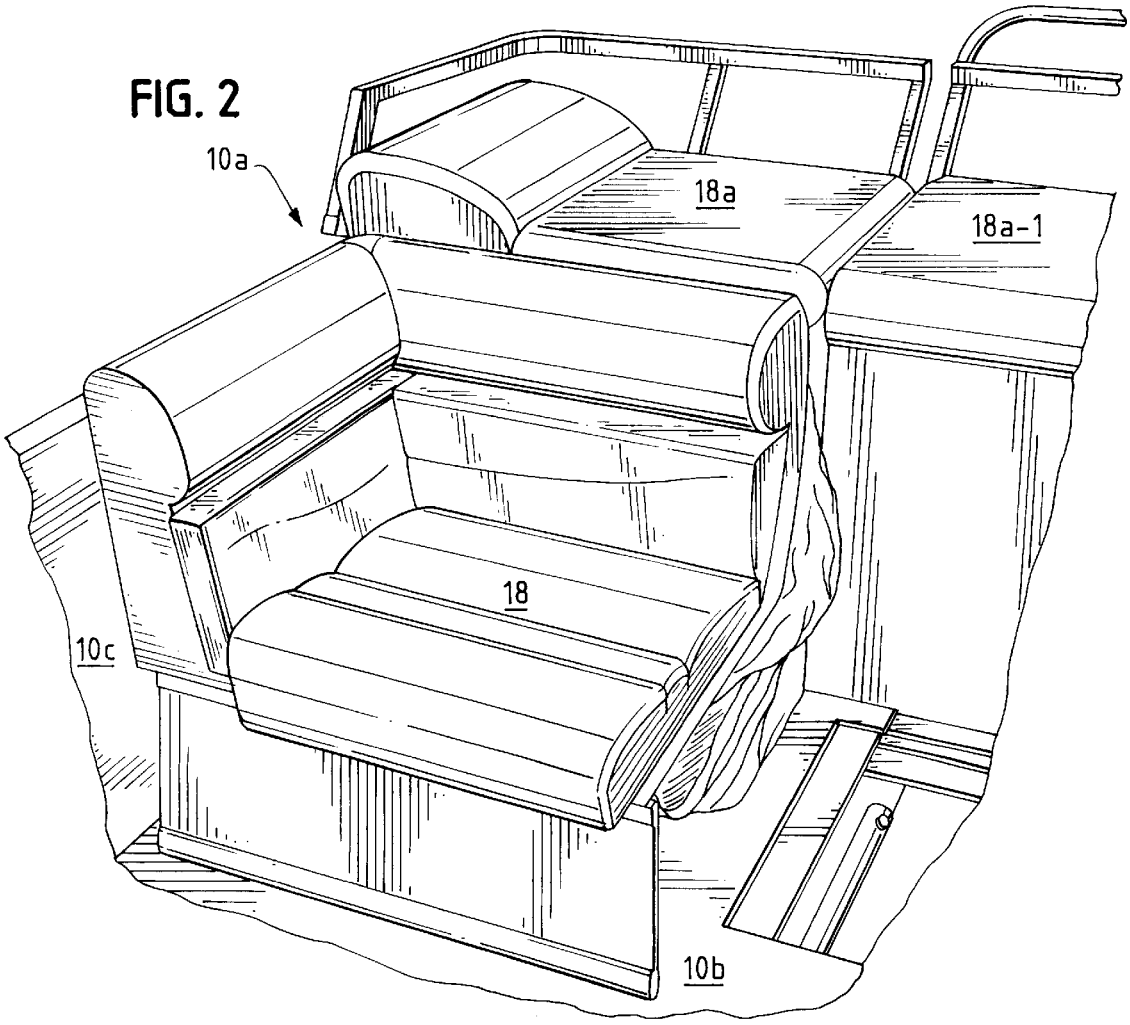
FIG. 2 is a perspective view of a comer of the stern of the boat of FIG. 1 with a stowed enclosure.

FIG. 2 illustrates the apparatus 12 when stowed. In this state, a seat 18 is available at the comer of the stem 10*a*, adjacent the transom. Behind the seat 18 is a reclining cushion 18*a* of a type found on many watercraft. Seat 18 is positioned next to a side wall of the hull 10*c*.

In the stowed configuration, FIG. 2, the apparatus 12, as a practical matter is completely out of the way and does not intrude into any usable deck space. If desired, a portable toilet can be stowed under seat 18.

Figure 3:
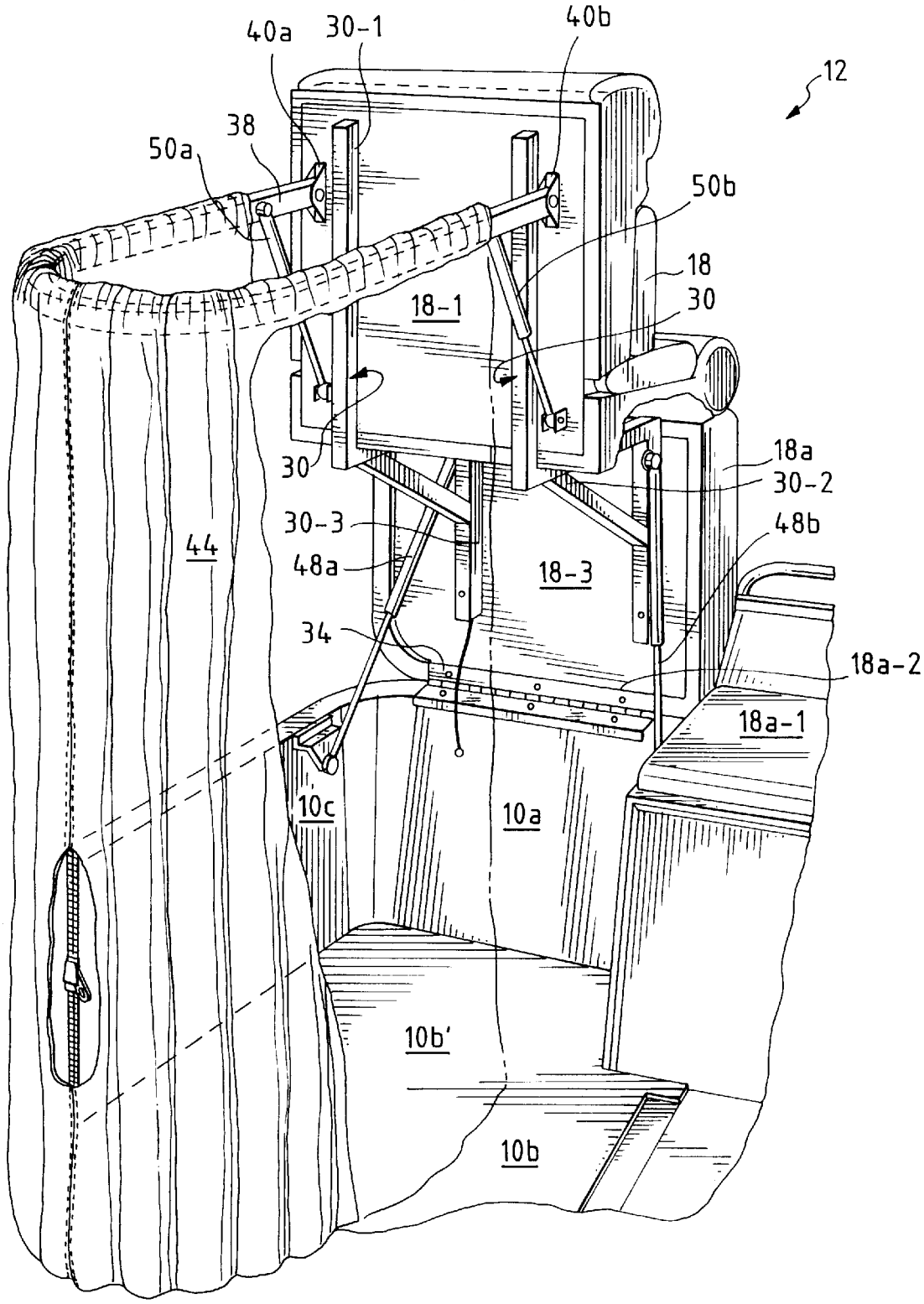
FIG. 3 is a perspective view of a corner of the stern of the boat of FIG. 1 with a deployed enclosure.
Figure 4:
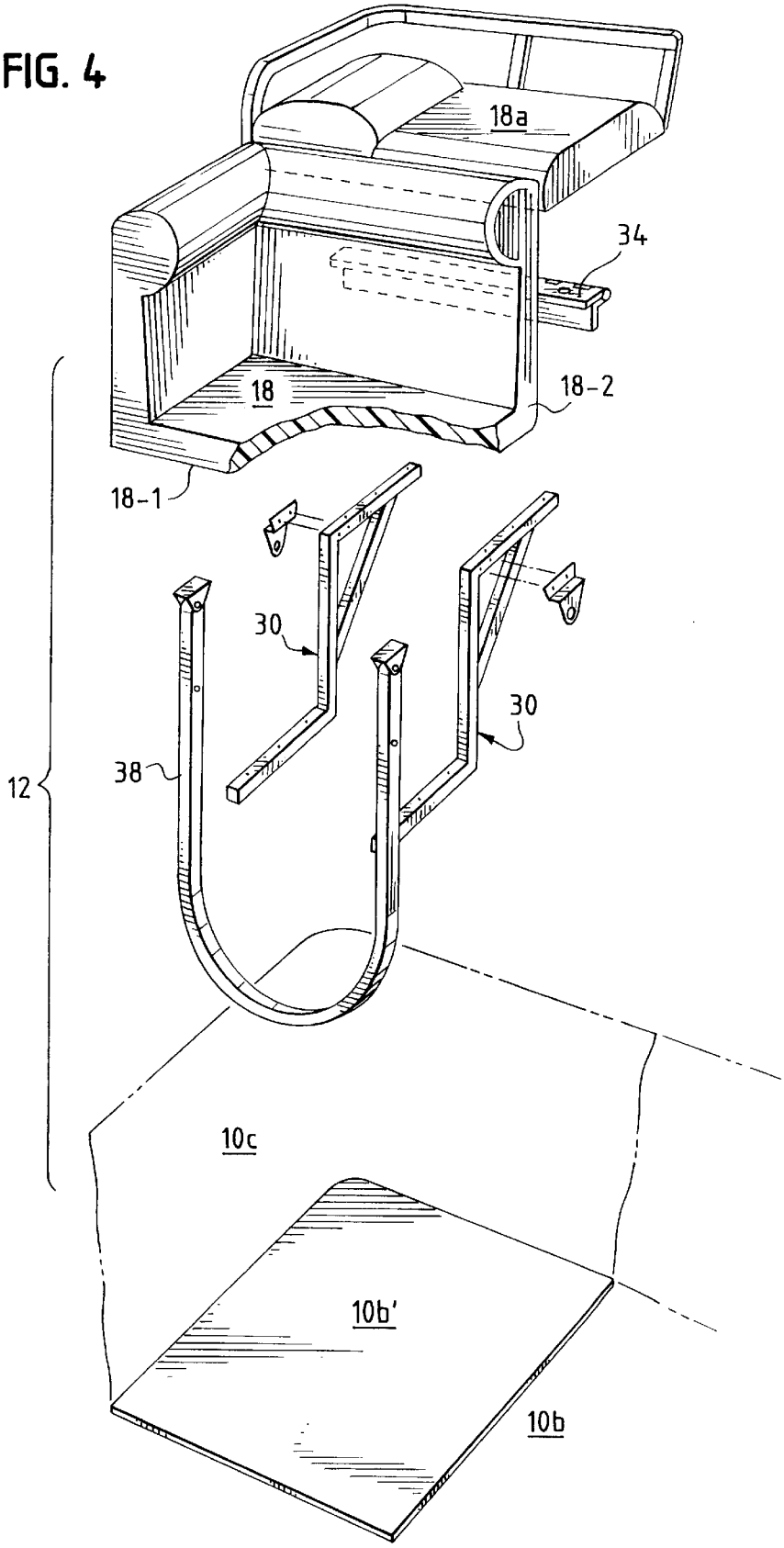
FIG. 4 is an exploded view of the stowable apparatus of FIG. 1.

FIG. 3 illustrates the apparatus 12 in a deployed state. As illustrated seat 18 has been rotated upwardly from its position illustrated in FIG. 2 to a position not usable for sitting but with the deployed changing room apparatus extended to its operative position.

Apparatus 12 includes first and second, identical brackets 30, each of which has a generally Z-shaped configuration with three sections 30-1,-2, and -3. These sections are respectively attached to a bottom surface 18-1, extend along a rear surface 18-2 of seat 18 and are attached to a lower surface 18-3 of cushion 18*a*.

A rear edge 18*a*-2 of cushion 18*a* is hingedly attached to stem 10*a* by a hinge 34. The adjacent cushion section 18*a*-1 does not need to be removed or displaced when the seat 18 is rotated up, as in FIG. 3 or back down, as in FIG. 2.

A generally U-shaped frame 38 is attached by pivots 40*a,b* to seat 18. When the seat 18 has been rotated upwardly as in FIG. 3, frame 38 can be pivoted to an extended position generally parallel to deck 10*b*. In this configuration, an enclosing, opaque sheet member 44 hangs from frame 38 and encloses a portion 10*b*' of deck 10*b* creating a temporary privacy region.

A boater can unzip or unfasten the member 44, enter the enclosure and change, shower or use a portable toilet as desired. When finished, that person can leave the enclosed area, rotate the frame 38 back against seat surface 18-1 and pull seat 18 back down to its normal position. The fabric member 44 will be stowed out of the way, under seat 18 until the room is needed.

One or more gas struts 48*a,b* will support assembly 12 in the deployed state of FIG. 3. One or more gas struts 50*a,b* can be used to support frame 38 in its extended position as long as needed.

FIG. 5 illustrates first and second U-shaped support brackets 56*a,b* which can be attached to deck 10*b*. The brackets 56*a,b* support seat 18 when it has been rotated down to its normal usage position. FIG. 6 illustrates an elongated support member 58 attached to an outboard side of seat 18 to fill any space between that seat surface and the side of the hull adjacent to the seat when the seat has been rotated down to its normal usable position.

FIG. 7 illustrates an alternate embodiment wherein the apparatus 12 also supports a shower head 60. When in a deployed state as in FIG. 7, a boater can shower in the enclosed region. Water can be gravity fed from an elevated water supply or from a pumped water supply.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A stowable room comprising:

a rotatably attachable double sided member having first and second stable positions and carrying on one side a seat and on the other side at least one elongated, planar, flexible changing room defining element said flexible changing room defining element comprising a substantially freely hanging curtain means for forming a closable changing room, whereby when the member is in one position the seat is located and oriented so as to receive a user with a sitting posture with the flexible room defining element stored under the seat so as not to interfere with use of the seat and wherein when the member is rotated to a second stable position, the changing room defining element is deployed thereby displacing the seat.

2. A stowable room as in claim 1 which includes a hinge for rotatably coupling the member to a movable platform.

3. A stowable room as in claim 2 which includes a rotatably mounted changing room defining frame extendable when the member is in the second stable position.

4. A stowable room as in claim 3 wherein the frame is generally U-shaped.

5. A stowable room as in claim 4 wherein the frame is coupled to a biasing element.

6. A stowable room as in claim 3 herein the double sided member has a first and second parallel, displaced linear sections joined by a generally perpendicular intervening section.

7. A stowable room as in claim 3 which includes at least one biased support coupled to the double sided member.

8. A stowable room as in claim 7 wherein the biased support comprises a shock absorber.

9. A stowable room as in claim 1 wherein the member can be attached to a movable platform whereby a user can rest on the seat, while the platform is moving, or can enter the changing room also while the platform is moving.

10. A stowable room as in claim 1 wherein returning the member to the one position restores the seat to a normal, usable orientation with the room defining element stored thereunder.

11. A vehicle mountable, storable apparatus comprising:

a substantially Z-shaped support frame;

first and second spaced apart, shock absorbers pivotably coupled to the frame;

a U-shaped room defining element, rotatably coupled to the support frame, having first and second positions; and a fabric member carried by the element wherein when in one position the fabric bounds a changing region, and, when in the other position, the fabric is storable.

12. An apparatus as in claim 11 which includes a seat carried on one side of the support frame, displaced from the room defining element, whereby when in the other position the seat is oriented for normal usage.

13. An apparatus as in claim 12 which includes a hinge for attachment to the vehicle.

14. An apparatus as in claim 11 wherein the vehicle is a watercraft and including a hinge having first and second parts, rotatable with respect to one another with one part attached to the frame and with another part attachable to the watercraft.

15. A vehicle mountable assembly comprising:

a hinge for attachment to the vehicle;

a seat coupled to the hinge wherein the seat has at least first and second positions relative to the hinge, when in the first position the seat is oriented for normal usage, when in the second position the seat is oriented to expose a bottom surface thereof;

a bracket attached at least in part to the seat and extending at least in part along the bottom surface of the seat;

a fabric support, rotatably coupled to and supported adjacent to the bracket, having first and second positions with the support extending substantially perpendicularly from at least part of the bracket when in the first position and extending substantially parallel to at least part of the bracket when in the second position; and a flexible fabric sheet member, carried by the support, wherein the member deploys to form a substantially freely hanging curtain means for providing an enclosed privacy region when the support is in the first position and is storable adjacent to the bottom of the seat when the support is in the second position.

16. An apparatus as in claim 15 which includes at least one biasing member coupled to the bracket for supporting the seat in the second position.

17. An apparatus as in claim 16 wherein the biasing member comprises a shock absorber.

18. An apparatus as in claim 15 which includes at least one biasing member coupled to the bracket for supporting the seat in the second position and another biasing member, coupled to the fabric support for supporting the fabric support when in the first position.

19. An apparatus as in claim 18 wherein the biasing member comprises a shock absorber.

20. An assembly as in claim 15 wherein the fabric support comprises a generally U-shaped frame having first and second parallel sides joined by an end perpendicular thereto.

21. An assembly as in claim 15 wherein both the bracket and the support are respectively spring loaded.

22. An assembly as in claim 15 which includes a horizontal surface member attached to the bracket, said horizontal surface member coupling said seat to said hinge.

23. A watercraft comprising:

a hull;

a deck carried on the hull wherein the deck is visible from regions displaced from the hull;

a stowable privacy providing apparatus hingedly coupled to a region of the hull, displaced from the deck, wherein when in a stowed state, the apparatus is folded so as not to occupy exposed deck area, and when rotated to a deployed state, the apparatus extends to form a substantially freely hanging curtain means for providing an enclosed privacy region, surrounding a portion of the deck and extending substantially perpendicularly thereto.

24. A watercraft as in claim 23 wherein the apparatus includes a pivotable frame which supports a flexible, opaque sheet member wherein when the frame is in one state, the sheet member is deployed to enclose at least in part, the portion of the deck.

25. A watercraft as in claim 23 wherein the apparatus includes a two sided bracket which supports a seat, usable when the apparatus is in a stowed state, and not usable as a seat when the apparatus is in a deployed state.

26. A watercraft as in claim 25 which includes a hinge coupled to the hull and wherein the bracket is coupled to the hinge.

27. A watercraft as in claim 25 wherein the seat is supported, at least in part, by the deck when the apparatus is in the stowed state.

28. A watercraft as in claim 25 wherein the bracket is located adjacent to the seat with at least a portion of the apparatus positioned between the seat and the deck in the stowed state.

29. A watercraft as in claim 28 wherein the apparatus includes a flexible sheet member located between the seat and the deck in the stowed state.

30. A watercraft as in claim 29 wherein the sheet member extends substantially perpendicular to the deck, surrounding in part the portion thereof.

31. A watercraft as in claim 30 wherein the sheet member is carried on a pivotably mounted frame which extends from the seat when in the deployed state.

32. A watercraft as in claim 28 wherein the apparatus includes a pivotable frame which is located between the seat and the deck in the stowed state.

33. A watercraft as in claim 32 wherein the frame is pivotable to an extended state when the apparatus is in the deployed state.

34. A stowable curtain assembly for a watercraft, comprising:

a deck structure;

a seat hingedly attached to the deck structure to be pivotable from a seat-providing position to an elevated position;

a curtain frame having a hoop-shaped member attached to a bottom of said seat; and a flexible curtain carried on said hoop-shaped member, said flexible curtain stowable beneath said seat when not deployed, and hanging substantially freely from said hoop-shaped member when deployed, forming an enclosed privacy area on the watercraft.

35. The stowable curtain assembly according to claim 34, wherein said hoop-shaped member is pivotably connected to said seat and is pivoted 180° when moved from a stowed position beneath said seat to a deployed position.

36. The stowable curtain assembly according to claim 35, comprising a bias member connected between said hoop-shaped member and said seat to hold said hoop-shaped member in its deployed orientation.

37. The stowable curtain assembly according to claim 35, comprising a bias member connected between said seat and said deck structure to hold said seat in its elevated orientation.

38. The stowable curtain assembly according to claim 34, wherein said curtain comprises a vertical, openable seam for access into or out of said privacy area.

39. The stowable curtain assembly according to claim 34, wherein said curtain comprises a rod pocket along an upper edge thereof for receiving said hoop-shaped member.

40. A stowable curtain assembly for a watercraft, comprising:

a deck structure having a horizontal deck surface and a vertical wall surface extending upwardly from said horizontal deck surface;

a seat having a horizontal seat surface and a vertical seat back extending upwardly from said seat surface;

a horizontal surface member extending from a top region of said seat back to the vertical wall surface;

a hinge connecting said horizontal surface member and said vertical wall surface;

said horizontal seat surface pivotable about said hinge from a seat providing position to an elevated position;

a hoop-shaped member attached to a bottom of said seat beneath said horizontal seat surface, movable to extend horizontally when said horizontal seat surface is pivoted to said elevated position; and a flexible curtain carried on said hoop-shaped member, said curtain stowable beneath said seat when not deployed, and hanging from said hoop-shaped member when deployed, forming an enclosed privacy area on the watercraft.

41. The stowable curtain assembly according to claim 40, wherein said seat includes a front edge which, in the elevated position of said horizontal seat surface is higher than said hoop-shaped member.

42. The stowable curtain assembly according to claim 40, wherein when said horizontal seat surface is pivoted to the elevated position, said seat completely clears said horizontal deck surface.

43. The stowable curtain assembly according to claim 40, wherein said horizontal surface member comprises a cushioned surface.

44. The stowable curtain assembly according to claim 40, wherein said hoop-shaped member is pivotably connected to said seat and is pivoted 180° when moved from a stowed position beneath said seat to a deployed position.

45. The stowable curtain assembly according to claim 40, wherein said curtain comprises a vertical, openable seam for access into or out of said privacy area.

46. The stowable curtain assembly according to claim 40, wherein said curtain comprises a rod pocket along an upper edge thereof for receiving said hoop-shaped member.

47. The stowable curtain assembly according to claim 40, comprising a bias member connected between said hoop-shaped member and said seat to hold said hoop-shaped member in its deployed orientation.

48. The stowable curtain assembly according to claim 40, comprising a bias member connected between said seat and said deck structure to hold said horizontal seat surface in the elevated position.

* * * * *

UNITED STATES PATENT AND TRADEMARK OFFICE

CERTIFICATE OF CORRECTION

PATENT NO. : 6,302,053 B1
DATED : October 16, 2001
INVENTOR(S) : Joseph B. Tomczak et al.

It is certified that error appears in the above-identified patent and that said Letters Patent is hereby corrected as shown below:

Column 2,
Line 37, please cancel "comer" and insert -- corner --;

Column 3,
Line 14, please cancel "comer" and insert -- corner --;
Line 35, please cancel "stem" and insert -- stern --.

Signed and Sealed this

Twenty-sixth Day of March, 2002

*Attest:*

*Attesting Officer*

JAMES E. ROGAN
*Director of the United States Patent and Trademark Office*